US008444285B2

(12) United States Patent
Lau

(10) Patent No.: US 8,444,285 B2
(45) Date of Patent: May 21, 2013

(54) CLIP LIGHT

(76) Inventor: Chi Hung Fermi Lau, Kowloon (HK)

( * ) Notice: Subject to any disclaimer, the term of this patent is extended or adjusted under 35 U.S.C. 154(b) by 161 days.

(21) Appl. No.: 12/928,110

(22) Filed: Dec. 2, 2010

(65) Prior Publication Data

US 2011/0075400 A1 Mar. 31, 2011

Related U.S. Application Data

(63) Continuation-in-part of application No. 12/658,423, filed on Feb. 10, 2010, now Pat. No. 8,201,961, which is a continuation-in-part of application No. 12/386,809, filed on Apr. 22, 2009, now Pat. No. 8,157,401.

(60) Provisional application No. 61/204,949, filed on Jan. 12, 2009.

(51) Int. Cl.
*F21V 21/84* (2006.01)

(52) U.S. Cl.
USPC ..... 362/105; 362/164

(58) Field of Classification Search
USPC ..... 362/103, 105, 107, 164, 183, 184, 362/191, 192, 212, 249.01, 249.02, 249.05, 362/249.1–249.13
See application file for complete search history.

(56) References Cited

U.S. PATENT DOCUMENTS

| | | | | |
|---|---|---|---|---|
| 5,541,816 | A * | 7/1996 | Miserendino | 362/106 |
| 6,435,689 | B2 * | 8/2002 | Pitts | 362/84 |
| 6,619,813 | B1 * | 9/2003 | Schnell | 362/116 |
| 7,425,082 | B1 * | 9/2008 | Jones | 362/285 |
| 2008/0232092 | A1 * | 9/2008 | Carter | 362/106 |
| 2009/0059607 | A1 * | 3/2009 | Yoon | 362/396 |

* cited by examiner

*Primary Examiner* — Julie Shallenberger
(74) *Attorney, Agent, or Firm* — Raymond Y. Chan; David and Raymond Patent Firm

(57) ABSTRACT

A clip light includes a light head, a power source, and a mounting arrangement. The light head includes a light housing having a light window, and a light source supported in the light housing to align with the light window. The power source is supported in the light housing to electrically link to the light source for providing electricity to generate light beam from the light source. The mounting arrangement adapted for detachably mounting the light head at a desired object, wherein the mounting arrangement is movably coupling with the light housing to selectively adjust a light projecting orientation of the light source through the light window with respect to the desired object.

15 Claims, 18 Drawing Sheets

CLIP LIGHT

CROSS REFERENCE OF RELATED APPLICATION

This is a Continuation-In-Part application that claims the benefit of priority under 35 U.S.C.§120 to a Continuation-In-Part application having an application Ser. No. 12/658,423 and a filing date of Feb. 10, 2010, which claims the benefit of a non-provisional application having an application Ser. No. 12/386,809 and a filing date of Apr. 22, 2009, which claims the benefit of priority under 35 U.S.C.§119(e) to a provisional application having an application number 61/204,949 and a filing date of Jan. 12, 2009.

BACKGROUND OF THE PRESENT INVENTION

1. Field of Invention

The present invention relates to a rotatable headlamp, and more particularly to a clip light which is able to selectively adjust a light projecting angle of the clip light.

2. Description of Related Arts

A conventional headlamp typically comprises a housing, a power source provided within the housing and an illuminating unit mounted in the housing and electrically connected with the power source, wherein the housing is adapted for wearing on a user's head through a strap so that a user is able to wear the headlamp on his or her head for providing illumination when he or she is performing some duties or personal work.

There several disadvantages for this kind of conventional headlamp. First, the headlamp must be affixed to the strap before it can be worn on the user's head. The conventional method is to affix the housing to the strap with little or no room for the housing to move with respective to the strap. In other words, when the housing is affixed to the strap, the illuminating angle of the illuminating unit cannot be freely adjusted. This present a great due of inconvenience to the user because when the user is wearing the headlamp on his or her head and he or she is in the course of performing some tasks, and when the user needs to adjust the angle of illumination so that he or she can view a particular object more clearly, the user has no choice but to either move his or her head to acquire the necessary angle of illumination, or detach the headlamp from his or her head and re-adjust the angle of inclination between the headlamp and the strap. Even this, the latter option may not be available because conventional headlamp may not provide connectors which facilitate pivotal movement between the housing or illumination unit with respective to the strap.

Second, recharging issues of conventional headlamp presents another disadvantage. For conventional headlamp, in order to recharge, the user has to detach the rechargeable battery for recharging. This also induces a great due of inconvenience to the user. When the rechargeable battery is detached from the headlamp, the user has to utilize designated charging equipment, such as a predetermined charger, for charging the rechargeable battery. Very often, however, the charger and the headlamp are separately located so that one may not be able to get the predetermined charger quick enough to resume the operation of the headlamp promptly.

Even if the orientation the headlamp for attaching onto a head band is adjustable, the projecting angle of the headlamp is limited within a predetermined angle or can only be moved in one direction. Therefore, the headlamp is unable to be flexibly rotated for illuminating the desired working area.

Furthermore, the light emitting apparatus mounted on a headband, or coupled at a brim of a hat or a cap have been widely applied for illuminating a dark working area for the freedom of both hands. A LED headlight is a well known type of lighting apparatus detachably coupling at the brim of the cap to illuminate the front crown working area. Take a clipper headlight for example, the clipper headlight has a clipper portion integrally provided at the headlight for attaching the headlight to a baseball type cap. In order to match the curve shape of the brim of the baseball type cap, the clipper on the headlight has a curve shape for detachably mounting on the front brim of the cap in a specific position.

However, the integrated clipper with the headlight is limited of applications. The headlight of fixed curve clipper cannot be reversely coupled to the top side of the brim of the cap. In other words, the headlight must clip at the bottom side of the brim of the cap such that the headlight will block a wearer vision. In addition, the headlight with fixed curve clipper has to be detachably mounted in a certain position on the brim of the cap for stably matching the curve of the baseball type cap. Furthermore, the clipper headlight fixed on the cap or the likes are fixedly toward in one direction only and can hardly be adjusted the projection of the light beam of the headlight to project to the working area. Additionally, the clipper integrated mounted on the headlight can not be detached to switch the clipper for different circumferences.

SUMMARY OF THE PRESENT INVENTION

The present invention is advantageous in that it provides a clip light for detachably clipping onto an object, such as a cap, hat, or the like, so that the clip light is able to be attach to a predetermined location for illuminating the environment in a hand free manner.

Another advantage of the present invention is to provide a clip light which is able to flexibly and selectively adjust a light projecting orientation in a three dimensional manner.

Another advantage of the present invention is to provide a clip light, wherein the light housing is able to be selectively rotated via the rotatable base to adjust the light projecting orientation along a first rotational surface.

Another advantage of the present invention is to provide a clip light, wherein the head portion pivotally coupling with the light housing is able to further selectively adjust the light projecting orientation along a second rotational surface, so as to provide a relatively wider and larger adjustable light projecting orientation.

Another object of the present invention is to provide a rotatable headlamp, which is able to be flexibly rotated in 3-dimentional manner.

Another object of the present invention is to provide a rotatable headlamp, which comprises a rotating member detachably coupling with the headlamp for Another object of the present invention is to provide a rotatable headlamp to comprising a mounting arrangement and a rechargeable dock which are capable of allowing convenient adjustment of an angle of inclination of a light head and recharging thereof respectively Another object of the present invention is to provide a rotatable headlamp comprising a mounting arrangement which allows the headlamp to be pivotally adjustable for a user to freely adjust the orientation of the illumination produced by the rotatable headlamp.

Another object of the present invention is to provide a rotatable headlamp comprising a rechargeable dock which is adapted to receive and electrically connect to a light head so as to allow recharging of the light head by electrically connecting the rechargeable dock to an external power source, such as an external AC power source.

Another object of the present invention is to provide a rotatable headlamp, wherein the rechargeable dock and the mounting arrangement are arranged to couple with a light head to form a single compact unit, so that the user is able to carry and use the rotatable headlamp in a convenient and efficient manner.

Another object of the present invention is to provide a Rotatable headlamp, which does not substantially alter the traditional structure of the light head, so as to minimize the manufacturing cost of the present invention, and to facilitate widespread application of the present invention.

Accordingly, in order to accomplish the above objects, the present invention provides a rotatable headlamp, comprising:

a light head comprising a light housing having a light window, and a LED light source supported in the light housing to align with the light window;

a rechargeable power source supported in the light housing;

a mounting arrangement movably coupling with the light housing to selectively adjust a light projecting orientation of the LED light source through the light window; and a rechargeable dock, which is adapted for electrically connecting with an external power supply, having a docking cavity detachably receiving the light head to charge the rechargeable power source.

Accordingly, a rotating member may further provided for rotatably and detachably coupling with a mounting panel of the mounting arrangement for rotatably adjusting the light oriental of the light head along an attachment surface of the rotating member, so as to selectively adjust the light projecting angle in 2-dimensional manner.

Additional advantages and features of the invention will become apparent from the description which follows, and may be realized by the following description of the instrumentalities and combinations particular pointing out in the appended claims.

According to the present invention, the foregoing and other objects and advantages are attained by providing a clip light, comprising:

a light head comprising a light housing having a light window, and a LED light source supported in the light housing to align with the light window;

a power source supported in the light housing; and a mounting arrangement which comprises a rotatable base rotatably coupling with the light housing and a clipping unit adapted for detachably coupling the light head with the desired object, wherein the light housing is selectively moved to adjust a light projecting orientation of the light source via the rotatable base when the clipping unit is coupled at the desired object.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
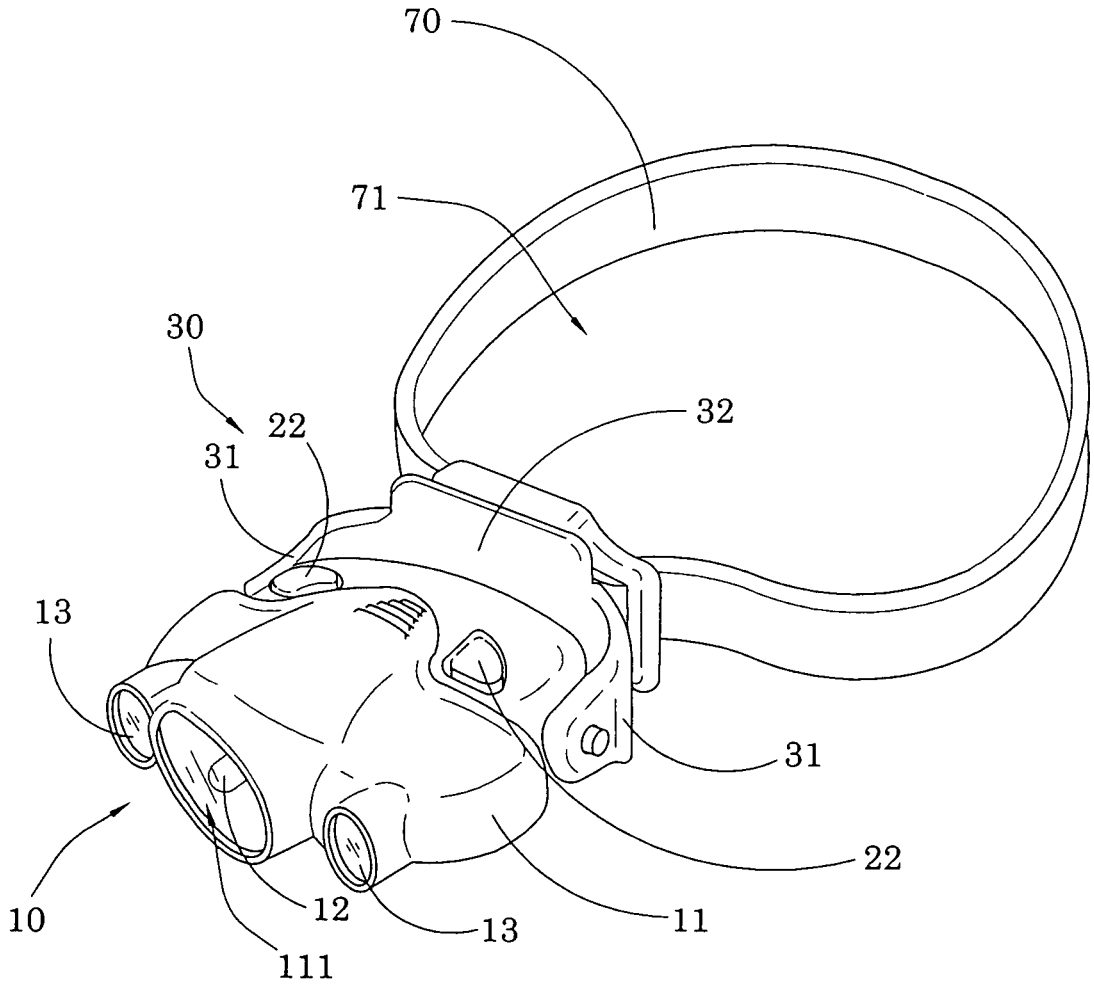
FIG. 1 is a perspective view of a rotatable headlamp according to a preferred embodiment of the present invention.
Figure 2A:
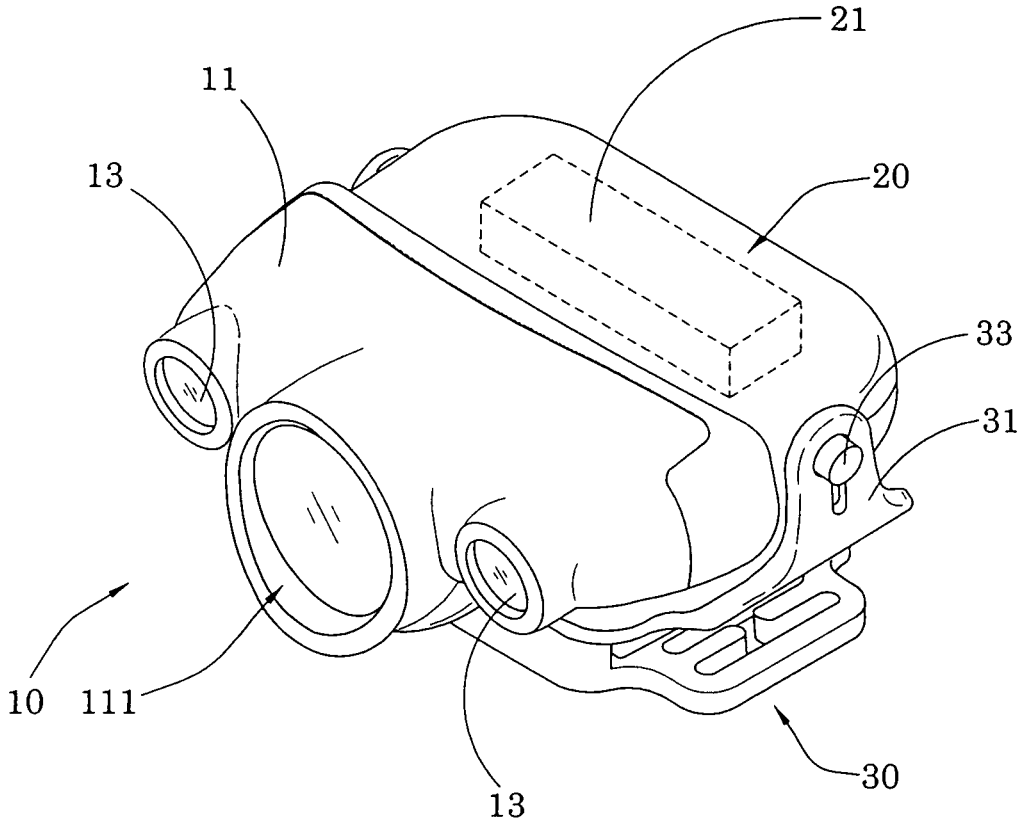
FIG. 2A and FIG. 2B are schematic diagrams of the rotatable headlamp according to the above preferred embodiment of the present invention, illustrating that the mounting arrangement is mounted on the light head.
Figure 2B:
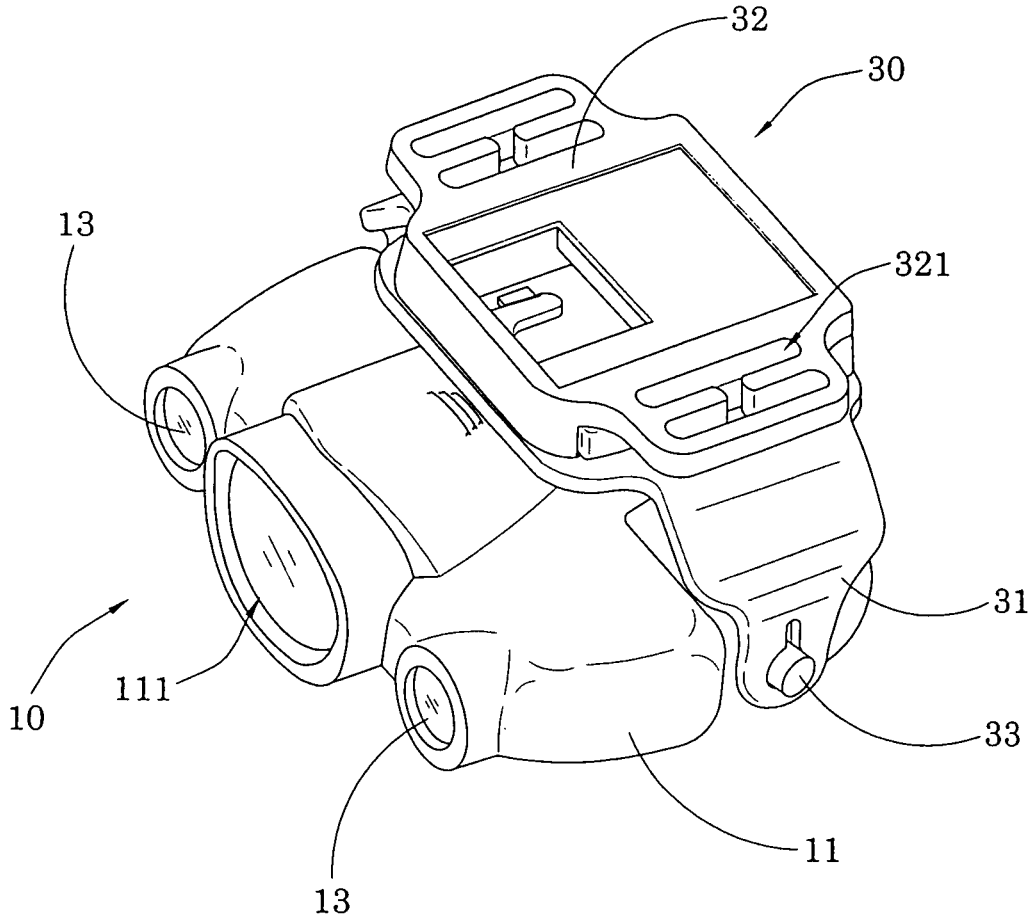
Figure 3A:
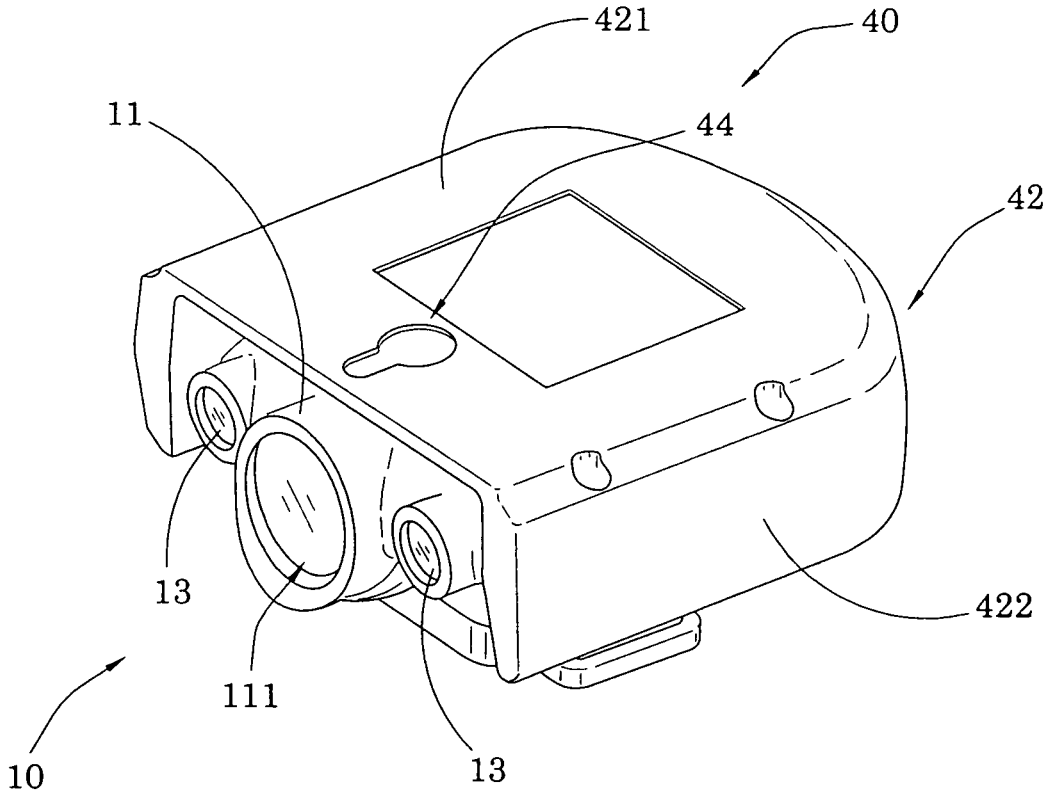
FIG. 3A and FIG. 3B are schematic diagrams of the rotatable headlamp according to the above preferred embodiment of the present invention, illustrating that the rechargeable dock is mounted on the light head.
Figure 3B:
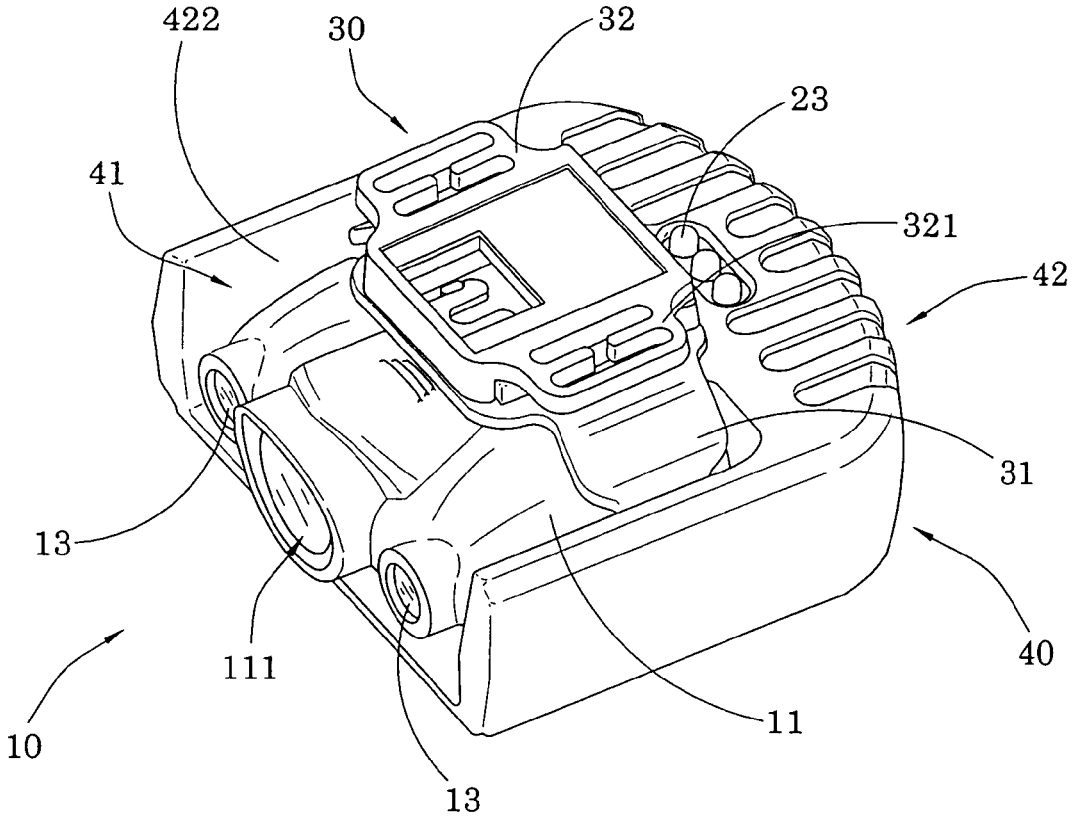
Figure 4:
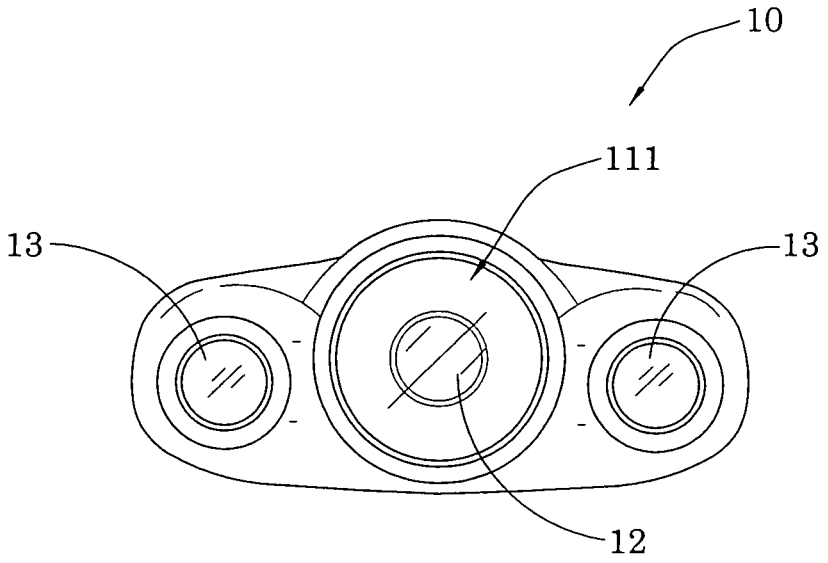
FIG. 4 is a front view of the rotatable headlamp according to the above preferred embodiment of the present invention.

Referring to FIG. 1, FIG. 2A, FIG. 2B, FIG. 3A, FIG. 3B and FIG. 4 of the drawings, a rotatable headlamp according to a preferred embodiment of the present invention is illustrated, in which the rotatable headlamp comprises a light head 10, a rechargeable power source 20, a mounting arrangement 30 and a rechargeable dock 40.

The light head 10 comprises a light housing 11 having a light window 111, and a LED light source 12 supported in the light housing 11 to align with the light window 111 so that the LED light source 12 is arranged to deliver illumination to an exterior of the light housing 11 through the light window 111. On the other hand, the rechargeable power source 20 is supported in the light housing 11 to provide electricity to the LED light source for allowing illumination thereof.

The mounting arrangement 30 is movably coupled with the light housing 11 to selectively adjust a light projecting orientation of the LED light source 12 through the light window 111. Accordingly, the mounting arrangement 30 is adapted for detachably mounting at a desired object, such as a user' head or a cap worn by the user, to retain the light housing 11 in position. In other words, the adjustable light projecting orientation allows a user to freely control the orientation of the illumination generated by the LED light source 12 for illuminating specific location designated by the user with respect to the desired object.

The rechargeable dock 40, which is adapted for electrically connecting with an external power supply, such as an external AC power supply, has a docking cavity 41 detachably adapted for receiving the light head 10 to charge the rechargeable power source 20.

According to the preferred embodiment of the present invention, the mounting arrangement 30 comprises two retention walls 31 rotatably and pivotally coupling with two sides of the light housing 11 to selectively adjust the light projecting orientation of the LED light source 12, and a mounting panel 32 extended between the retention walls 31 to form a U-shaped member, wherein the light housing 11 is arranged to be freely and pivotally move with respect to the mounting arrangement 30 for selectively adjusting the angle of illumination by the LED light source 12. It is worth mentioning that the pivotal coupling between the retention walls 31 and the light housing 11 can be accomplished by various conventional means, such as two screw connectors 33.

In order to allow the light head 10 to be worn on a user's head, the mounting panel 32 is arranged to be attached with a strap or a headband 70 for wearing on the user's head. As a result, the mounting panel 32 has a plurality of band slots 321 spacedly formed thereat for a headband 70 detachably fastening at the mounting panel 32 at the corresponding band slots 321 so as to enable the light head 10 being carried at a head portion of a user via the headband 70. The headband 70 is arranged to be length-adjustable so as to fit differing head sizes of different users. The headband 70 should be made of flexible materials, such as durable fabric or elastic material, for allowing the user to conveniently wear on his or her head and detach the rotatable headlamp from the body. Furthermore, each of the band slots 321 is preferably elongated in shape and is longitudinally and spacedly formed on the mounting panel 32 of the mounting arrangement 30 so as to allow the corresponding headband 70 to attach at the band slots 321 in such a manner that the headband 70 is arranged to form a wearing loop 71 adjustable to fittedly receive a user's head, so that the light housing 11 is mounted at a forehead of the user and that the light window 111 is oriented to provide illumination at a front side of the user's forehead, yet with adjustable angle of orientation through pivotal movement of the light housing 11.

On the other hand, the rechargeable power source 20 comprises a rechargeable battery 21 which is preferably embodied as a Li-ion rechargeable battery supported in the light housing 11, and two switch controls 22 spacedly provided at the light housing 11 for controllably switching the LED light source 12 in an on and off manner. As shown in FIG. 1, the two switch controls 22 are spacedly provided on the top side of the light housing 11 for easy accessing.

The rechargeable power source 20 further comprises a charging terminal 24 provided at the bottom side of the light housing 11 to electrically extend from the rechargeable battery 21.

In order to provide better illumination for the rotatable headlamp, the light head 10 further comprises two auxiliary light sources 13 provided at the light housing 11 at a position that the LED light source 12 is positioned between the auxiliary light sources 13, wherein each of the auxiliary light sources 13 has the same light projecting orientation of the LED light source 12 for providing additional light to illuminate a designated area or a targeted object aimed by the LED light source 12. The auxiliary light sources 13 are also electrically connected with the rechargeable power source 20 for acquiring electricity to provide additional lighting performance of the rotatable headlamp. According to the preferred embodiment of the present invention, the LED light source 12 is preferably embodied as an ultra power cree LED bulb while the auxiliary light sources 13 are embodied as white LED bulbs respectively. Together, they provide an optimal level of light directed at a predetermined or a desirable location through adjustment of the light housing 10 with respective to the mounting arrangement 30.

It is worth mentioning that the switch controls 22 are arranged to selectively operate the LED light source 12 and/or the auxiliary light sources 13 (i.e. a dual switch control) so that a user is allowed to select which light source (i.e. either the LED light source 12 or at least one of the auxiliary light source 13) or both light sources are to be utilized.

Preferably, one of the switch controls 22 is arranged to switch one of the LED light source 12 and the auxiliary light sources 13 in an on and off manner, while another switch control 22 is arranged to switch between a main light mode and an auxiliary light mode. Accordingly, the main light mode is that the LED light source 12 is activated and the auxiliary light mode is that the auxiliary light sources 13 are activated.

Referring to FIG. 1, FIG. 2A, FIG. 2B, FIG. 3A, FIG. 3B and FIG. 4 of the drawings, the rechargeable power source 20 further comprises a LED charging indicator 23 provided on the rechargeable dock 40 for indicating a status of the rechargeable power source 20. The LED charging indicator 23 can be embodied as at least one LED provided on the rechargeable dock 40 for illuminating a particular color of light to indicate the corresponding charging status. For example, a green light may represent that the rechargeable power source 20 has been fully charged, while a yellow light represents that the rechargeable power source 20 is being properly recharged.

The rechargeable dock 40 comprises a dock body 42 having a docking base 421 and at least one side docking wall 422, preferably two side docking walls, integrally extended from the docking base 421 to form the docking cavity 41 within the docking base 421 and the side docking wall 422. The rechargeable dock 40 further comprises an electric terminal 43 provided within the docking cavity 41 either on the docking base 421 or the side docking wall 422 for electrically connecting the light head 10 with an external power source, such as an external AC power source.

Figure 5:
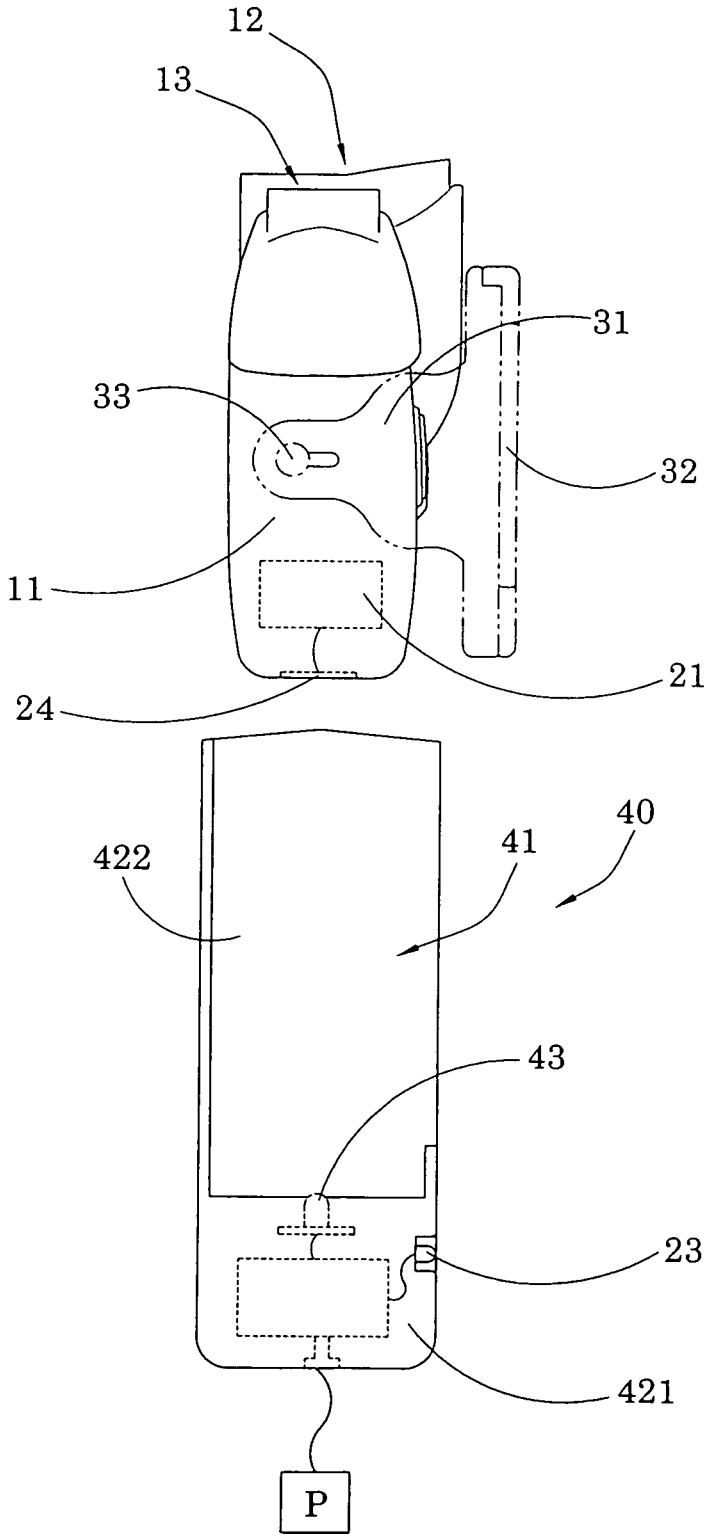
FIG. 5 is a side view of the rotatable headlamp according to the above preferred embodiment of the present invention, illustrating the charging terminal of the light head being contacted with the electric terminal of the rechargeable dock for recharging purpose.

As shown in FIG. 5, the electric terminal 43 is provided at the bottom wall of the docking cavity 41 to electrically contact with the charging terminal 24 of the rechargeable power source 20 when the light housing 11 is disposed within the docking cavity 41 so as to recharge the rechargeable battery 21. It is worth mentioning that the light head 10 can be disposed at the docking cavity 41 of the rechargeable dock 40 without detaching the mounting arrangement 30 from the light head 10. In other words, the mounting arrangement 30 is pivotally folded at the top side of the light head 10 in order to dispose the light head 10 at the docking cavity 41 of the rechargeable dock 40.

In order to impart wider application of the present invention, the rechargeable dock 40 contains a wall mounting slot 44 provided at the rear side of the rechargeable dock 40 for detachably mounting the rechargeable dock 40 on a wall surface via a fastener, such that when the light head 10 is received in the rechargeable dock 40, the light head 10 forms a wall light for illumination. In addition, the rechargeable dock 40 can be suspendedly hung on the wall surface to recharge the rechargeable battery 21 when the light head 10 is disposed at the rechargeable dock 40.

The light housing 11 and the mounting arrangement 30 and the rechargeable dock 40 are preferably made of durable yet reasonably light materials such as ABS plastic for allowing the user to utilize the present invention in a wide variety of circumstances.

Figure 6:
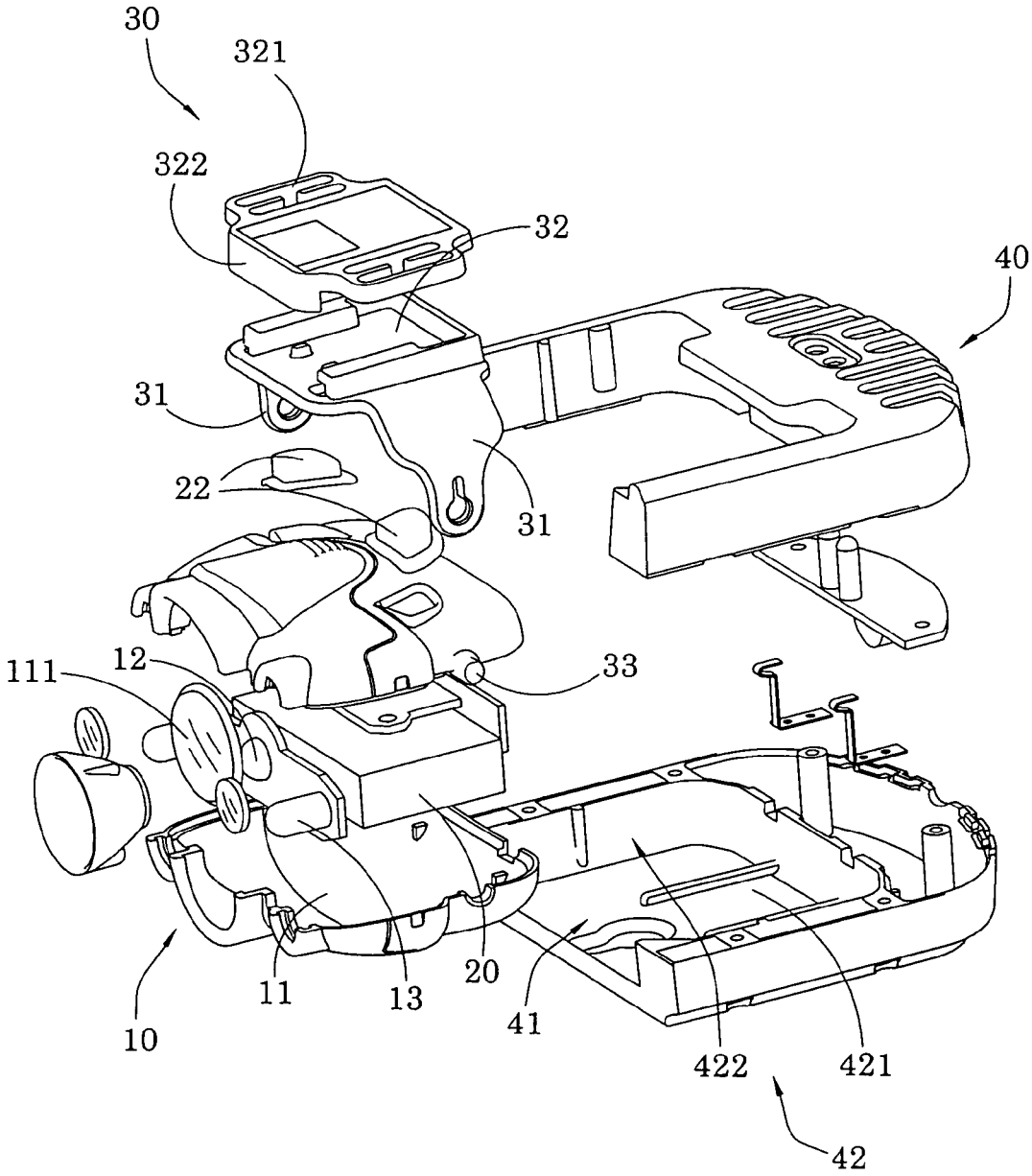
FIG. 6 is an exploded perspective view of the rotatable headlamp according to the above preferred embodiment of the present invention.
Figure 7:
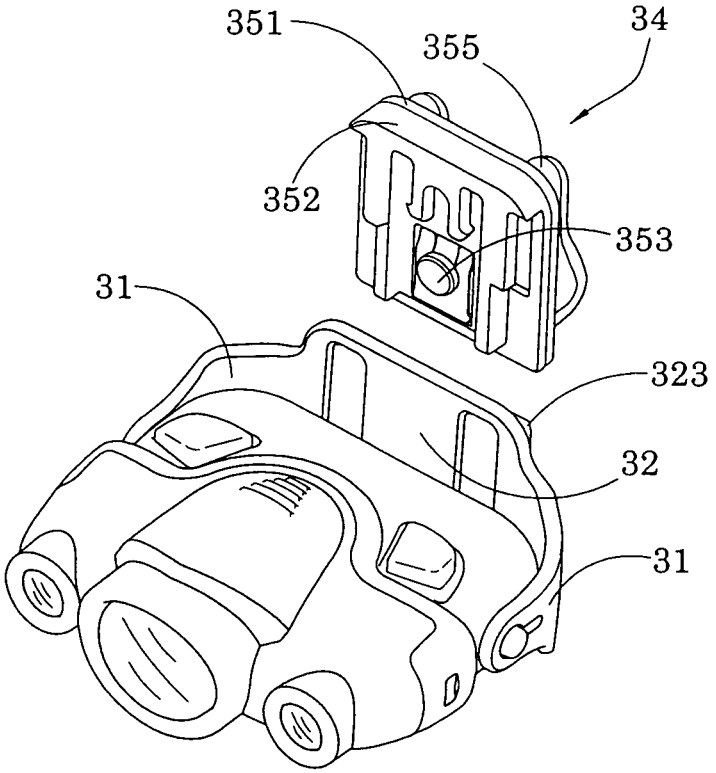
FIG. 7 is another perspective view of the rotatable headlamp according to the above preferred embodiment of the present invention, illustrating a detachably mounting base of the mounting panel being detached from the mounting panel.
Figure 8:
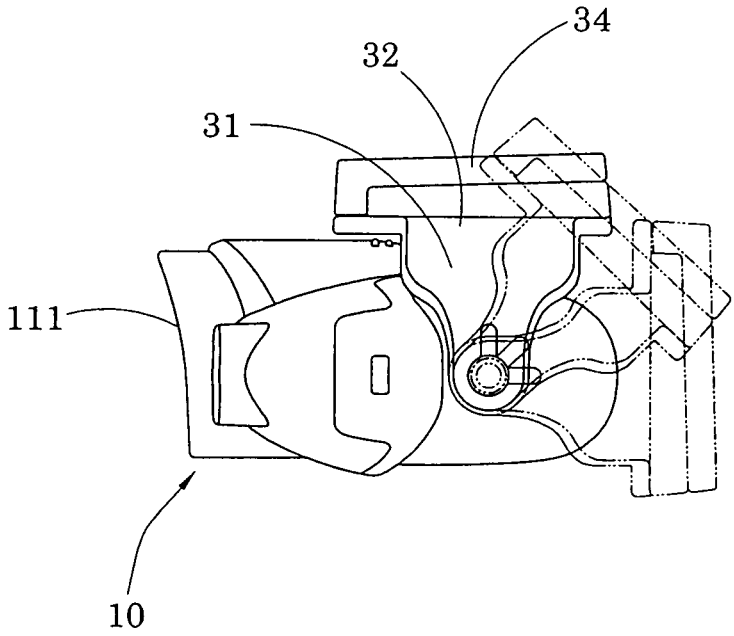
FIG. 8 is another side view of the rotatable headlamp according to the above preferred embodiment of the present invention, illustrating the light head rotatably moving in one-dimension manner.

As shown in FIGS. 6 to 8, the mounting panel 32 of the mounting arrangement 30 further comprises a detachable mounting base 322 forming the plurality of band slots 321 thereon. At least a mounting slot 323 is preferably provided at a rear side of the mounting panel 32 for receiving the mounting base 322, so that the mounting base 322 is able to detachably coupling at the mounting panel 32, so as for coupling the light head 10 to the headband 70. Therefore, the light head is detachably coupling with the headband 70 for being worn on the user's forehead for rotatably adjusting the orientation of the light head in one dimensional manner via the mounting arrangement 30, as shown in FIG. 8.

Figure 9A:
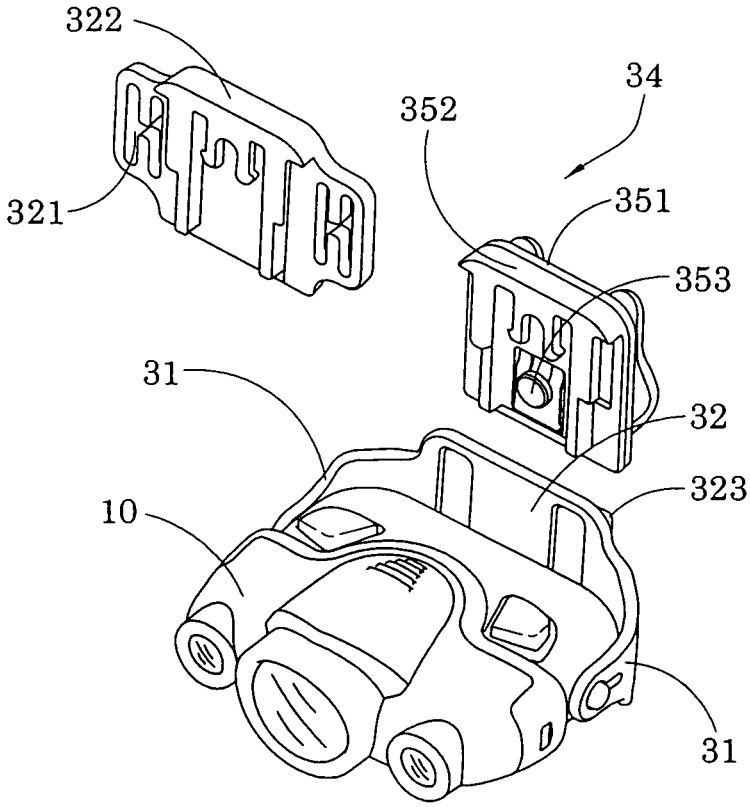
FIG. 9A is another perspective view of the rotatable headlamp according to the above preferred embodiment of the present invention, illustrating a rotating member of the mounting arrangement detachably coupling with the mounting panel, so that the light head is able to move in three-dimensional manner.
Figure 9B:
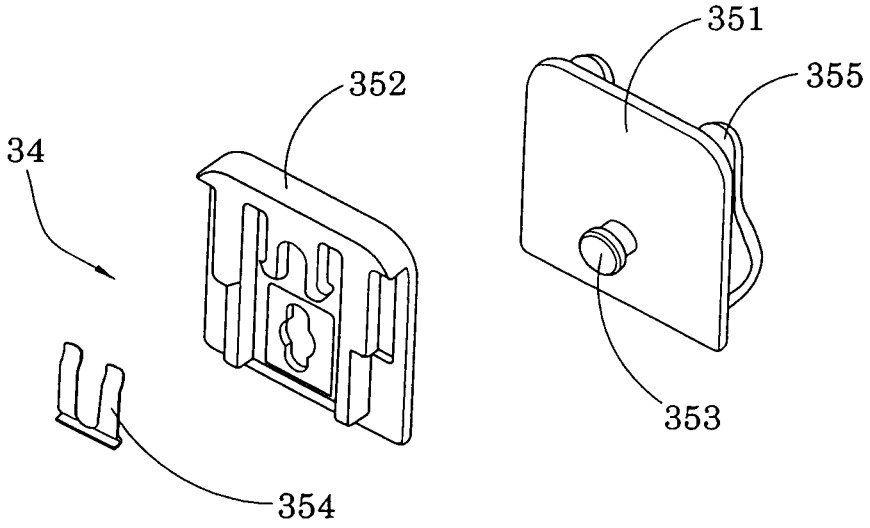
FIG. 9B is an exploded view of the rotating member of mounting arrangement according to the above preferred embodiment of the present invention.

Referring to FIGS. 9A and 9B, the mounting arrangement 30 further comprises a rotating member 34 detachably and rotatably coupling with the mounting panel 32, so that the light head 10 is able to rotatably moving along a plane of the rotating member 34. Therefore, the light head is able to rotate along an axis between the side walls 31 and the light head 10, and the plane of the rotating member 34 in a three dimensional manner.

Accordingly, the rotating member 34 further comprises a detachable base 352 for detachably coupling with the light head 10 via the mounting slot 323, and a rotatable base 351 rotatably coupling with the detachable base 352. In addition, the mounting base 322 and the detachable base 352 are interchangeable to detachably and selectively couple with the mounting panel 32.

As shown in FIG. 9B, the rotatable base 351 comprises a rotatable shaft 353 extended towards the detachable base 325, wherein the detachable base 325 has a through slot for the rotatable shaft 353 of the rotatable base 351 passing through in such a manner that when the rotatable shaft 353 is slidably extended through the through slot of the detachable base 352, the rotatable base 351 is rotatably engaged with the detachable base 352. Accordingly, the detachable base 352 is detachably coupled with the mounting panel 32 such that the rotatable base 351 is rotatably coupled with the mounting panel 32 via the detachable base 352.

According to the preferred embodiment, the rotatable shaft 353 has an enlarged head portion and an elongated neck portion, wherein when the rotatable shaft 353 is slidably passing through the through slot of the detachable base 352, the head portion of the rotatable shaft 353 is located at the front side of the detachable base 352 while the rotatable base 351 is located at the rear side of the detachable base 352.

The rotatable member 34 further comprises a fastener 354 fastening the rotatable shaft 353 at the front side of the detachable base 352 to retain the rotatable base 351 at the rear side of the detachable base 352. Accordingly, the fastener 354 comprises a U-shaped resilient element coupling with the neck portion of the rotatable shaft 353 not only to retain the rotatable base 351 at the rear side of the detachable base 352 but also to apply an urging force between the head portion of the rotatable shaft 353 and the detachable base 352 so as to ensure the rotatable base 351 being overlapped at the rear side of the detachable base 352 in a rotatably movable manner.

As it is mentioned above, the light housing 11 can be freely and pivotally move with respect to the mounting panel 32 for selectively adjusting the angle of illumination by the LED light source 12. In addition, the light housing 11 can also be freely and rotatably moved with respect to the rotatable base 351. Therefore, the rotatable headlamp is able to rotatably and selectively adjust the light projection orientation in three-dimensional manner.

In order to detachably and conveniently position the light head 10 at a predetermined object for illuminating the exterior, the rotatable member 34 further comprises a clip member for detachably clipping the light head 10 onto the to predetermined object, wherein the clip member preferably comprises two clipping arms 355 spacedly being mounted at a rear side of rotatable base 351, so that light head 10 is able to adjustably clip at the predetermined object such as a visor of a cap.

The rotatable member 34 is able to detachably attach to the mounting panel 32 via attaching to the mounting base 322 with the band slots 321 or the detachable base 325. In other words, the detachable base 352 and mounting base 322 with the band slots 321 are interchangeable, so that the light head 10 is able to selectively attach to the mounting base 322 or the detachable base 352 for interchanging one of the mounting base 322 for attaching the light head 10 to the headband 70 via the band slots 321 and the detachable base 352 for clipping at the desired object.

Figure 10A:
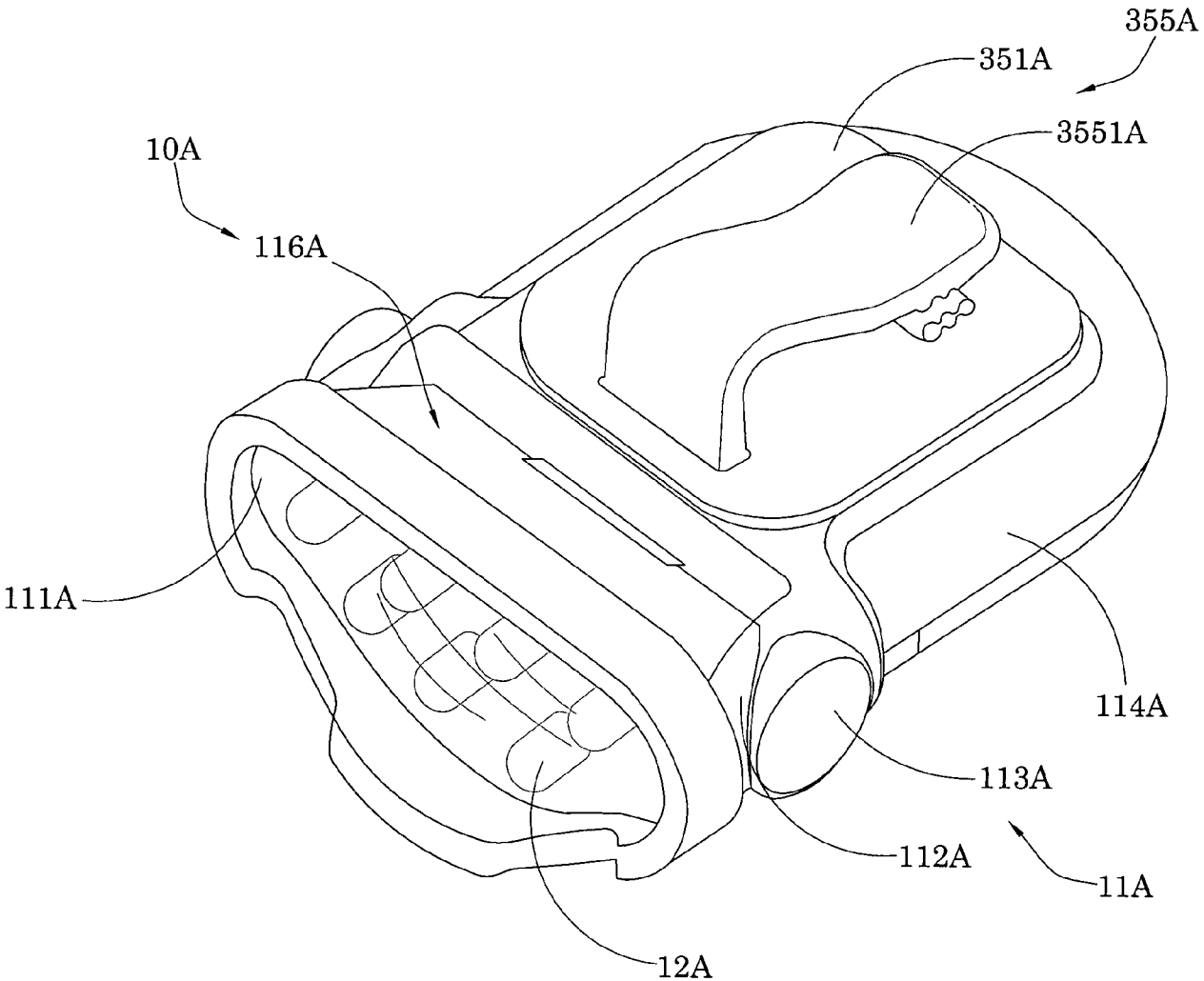
FIG. 10A is a bottom perspective view of a clip light according to another preferred embodiment of the present invention.
Figure 10B:
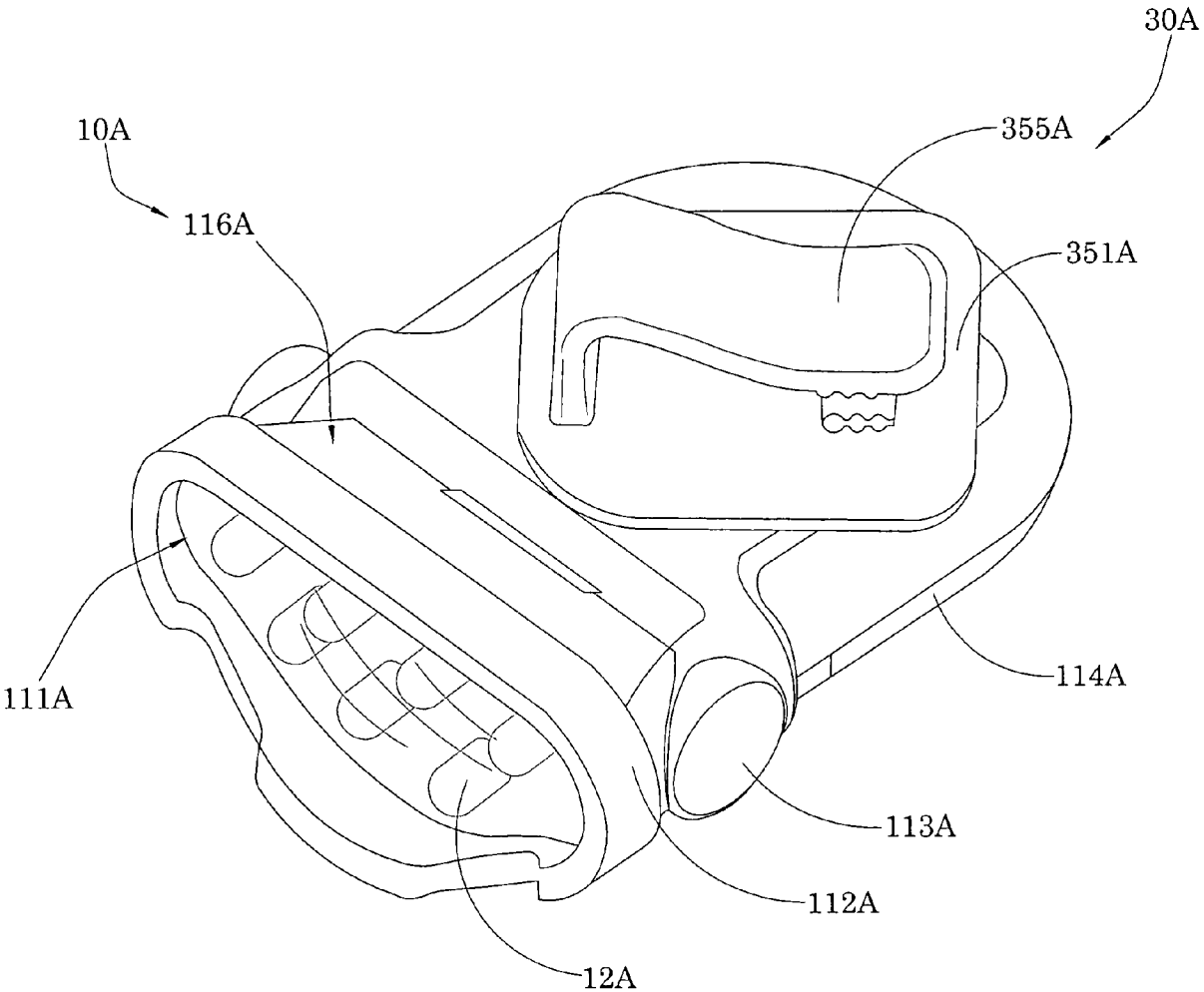
FIG. 10B is a bottom perspective view of a clip light according to above preferred embodiment of the present invention, illustrating the mounting arrangement being movably rotated to adjust a light projecting orientation.
Figure 10C:
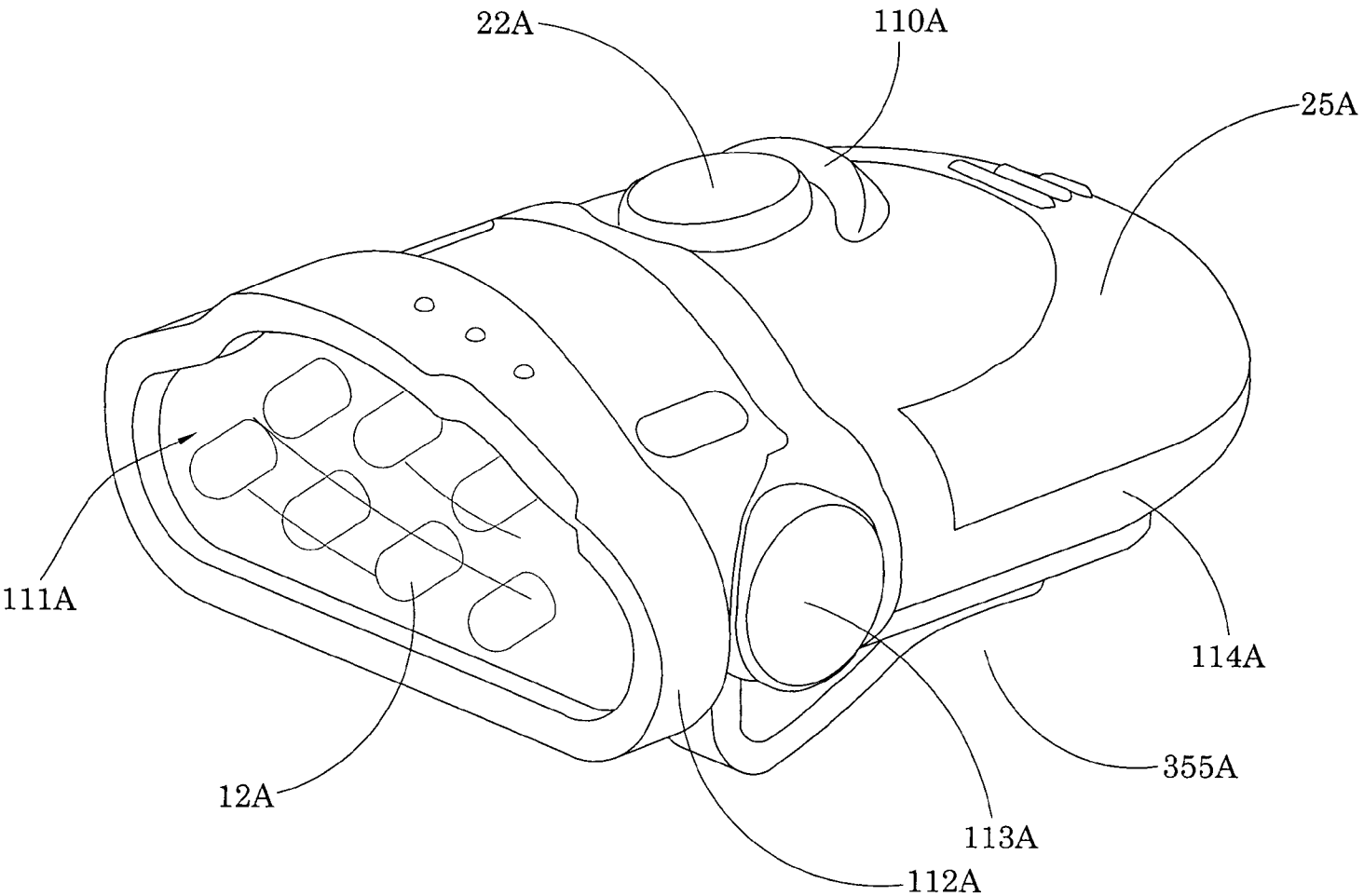
FIG. 10C is a top perspective view of the clip light according to another preferred embodiment of the present invention.

Referring to FIGS. 10A to 10C of the drawings, a clip light according to another preferred embodiment of the present invention is illustrated, wherein the clip light comprises a light head 10A, a power source 20A, and a mounting arrangement 30A.

Figure 12:
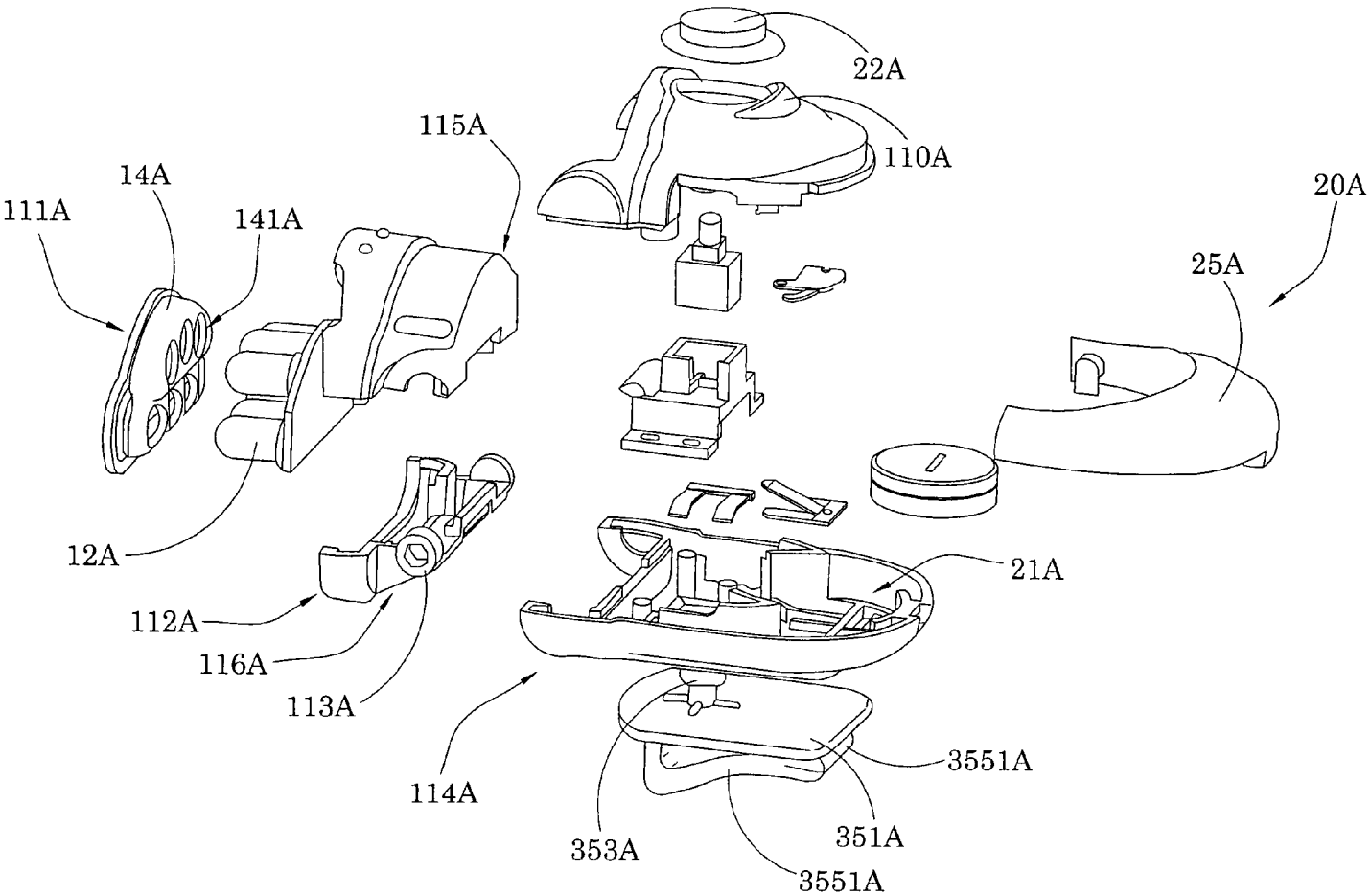
FIG. 12 is an exploded perspective view of the clip light according to the above preferred embodiment of the present invention.

As shown in FIG. 12, the light head 10A comprises a light housing 11A and a light source 12A being supported within the light housing 11A, wherein the light source 12A is electrically linked to the power source 20A for generating an illuminating light out of the light housing 11A, so as to illuminate the outer environment. The light housing 11A preferably has a light window 111A, so that the light source 12A is arranged to align with the light window 111A for delivering illumination to an exterior of the light housing 11A through the light window 111A. On the other hand, the power source 20A is supported in the light housing 11A to provide electricity to the LED light source for allowing illumination thereof.

The mounting arrangement 30A is movably coupled with the light housing 11A to selectively adjust a light projecting orientation of the light source 12A, which is preferably LEDs, through the light window 111A. Accordingly, the mounting arrangement 30A preferably is adapted for detachably mounting at a desired object, such as a user headband or a cap worn on a head of the user, to retain the light housing 11A in position, so that the user is able to illuminate the environment in a hand-free manner. The adjustable light projecting orientation allows the user to freely control the orientation of the illumination generated by the LED light source 12A for illuminating specific area designated by the user with respect to the desired object.

According to the preferred embodiment, the mounting arrangement 30A comprises a rotatable base 351A rotatably mounted at the bottom wall of the light housing 11 of the light head 10, and a clipping unit 355A extended from the rotatably base 351A for detachably clipping onto the desired object, so that when the clip light is clipping onto the desired object, the light housing 11A is able to be rotated in relation to the clipping unit 355A to adjust the light projecting orientation of the generated light from the light source 12A. Therefore, the user is able to freely rotate the light housing 11A to selectively adjust the light projecting angle thereof in order to illuminate the predetermined area or object.

The clipping unit 355A preferably has at least a clipping arms 3551A, embodied as two clipping arms 3551A for detachably affixing the light housing 11A at a predetermined location of the desired object, such as at visor portion of a cap, so that the clipping unit 355A is able for detachably coupling the light housing 11A at the desired object to illuminate the exterior of the light housing 11A in the hand free manner. In other words, the clipping arms 3551A are spacedly extended at an outer attachment surface of the light housing 11A for adjustably coupling at the predetermined object. It is worth to mention that the clipping arms 3551A may have a predetermined curvature for matching a relatively larger curvature range of an object such as the curvature of the visor portion of the cap, so that the clip light can be detachably mounted to different objects having different curvature, or the clip light can be reversely mounted on a top of the visor of the cap for preventing the clip light from blocking a view of the wearer.

The rotatable base 351A may further comprise a rotatable shaft 353A perpendicularly extended to the attachment surface of the light housing 11A, wherein the rotatable shaft 353A of the rotatable base 351A is extended through a through slot at the attachment surface of the light housing 11A, in such a manner that the rotatable base 351A is rotatably engaging with the light housing 11A via the rotatable shaft 353A to selectively adjust the light housing 11A at a left-and-right direction. Alternatively, the rotatable base 351A can be interlockingly and rotatably coupling at the light housing 11A, such as a circular protruding elements at the rotatable base 351A and a corresponding circular groove at the attachment surface of the light housing 11A for rotatably interlocking therewith, so as to adjust the light projecting orientation of the light source 12A at the light housing 11A.

In this preferred embodiment, the rotatable shaft 353A has an enlarged head portion and an elongated neck portion, wherein when the rotatable shaft 353A is slidably passing through the through slot of the attachment surface of the light housing 11A, the head portion of the rotatable shaft 353A is located at the inner side of the attachment surface while the rotatable base 351A is located at the outer side of the attachment surface of the light housing 11A. Accordingly, a fastener, which can be a U-shaped resilient element, can be coupled with the neck portion of the rotatable shaft 353A not only to retain the rotatable base 351A at the outer side of the attachment surface but also to apply an urging force between the head portion of the rotatable shaft 353A and the attachment surface so as to ensure the rotatable base 351A being overlapped at the outer side of the attachment surface in a rotatably movable manner.

As will be readily appreciated by one skilled in the art, the retention base 352, as mentioned in the above preferred embodiment, can also be adapted for detachably coupling the rotatably base 351A with the attachment surface of the light housing 11A, so that the rotatably base 351A with the clipping unit 355A may be interchangeable with the above mentioned variety of types of mounting arrangement 30.

Figure 11:
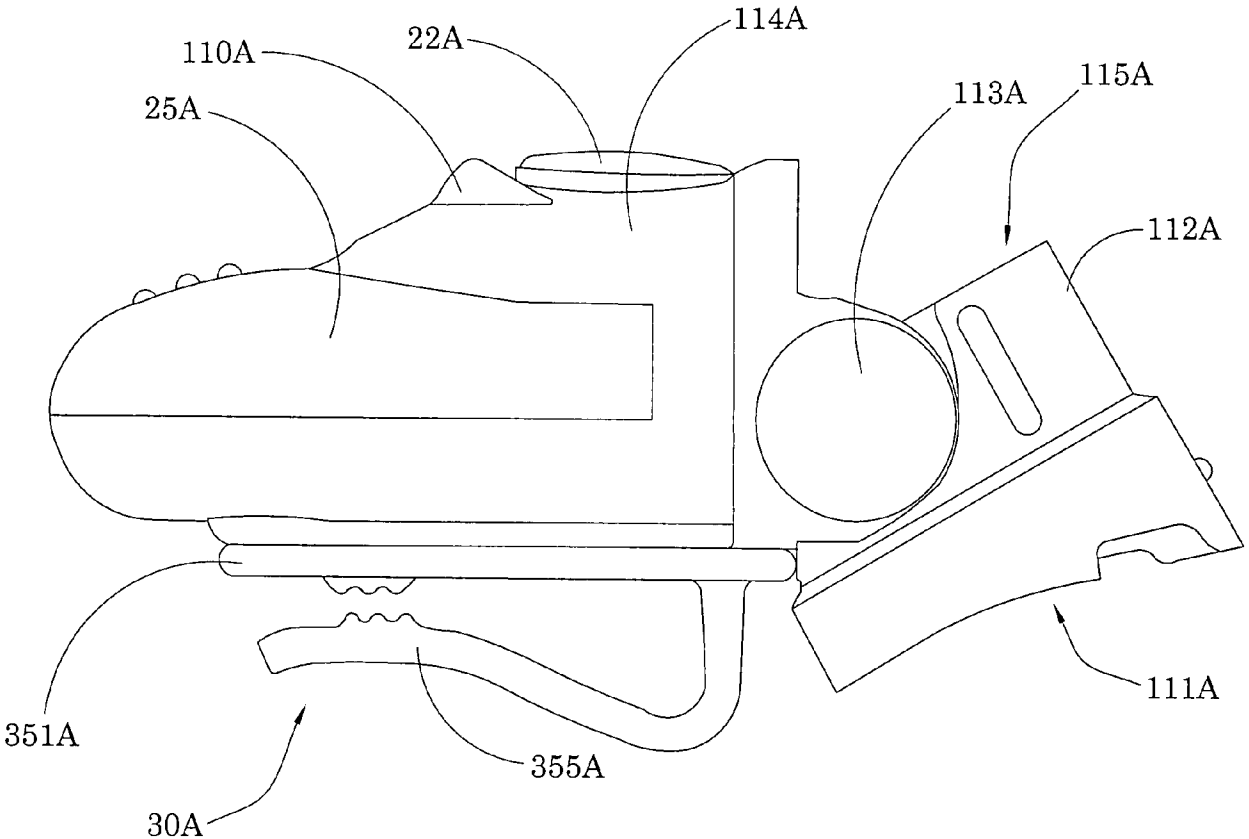
FIG. 11 is a side view of the clip light according to the above preferred embodiment of the present invention, illustrating the adjustable head being moved from the first projecting position to the second position.

According to the preferred embodiment, the light housing 11A preferably further comprises a housing body 114A and an adjustable head 112A pivotally connecting to the housing body 114A and to define the light window 111A at the adjustable head 112A, as shown in FIG. 11, wherein the light source 12A is preferably supported in the adjustable head 112A to align with the light window 11A and electrically linked to the power source 20A within the light housing 11A for providing the necessary electricity to generate the light therefrom, in such a manner that the light projecting orientation is able to be further pivotally adjusted via pivotally moving the adjustable head 112A of the light housing 11A. Accordingly, the rotatable base 351A is rotatably coupled at the housing body 114A.

More specifically, the adjustable head 112A is pivotally coupling with the housing body 114A via a joint member 113A to pivotally couple the adjustable head 112A with the housing body 114A, wherein the light source 12A is received at the adjustable head 112A such that the adjustable head 112A is selectively moved to adjust the light projecting orientation of the light source 12A. Accordingly, the joint member 113A comprises a pivot axle extending at a longitudinal direction of the light housing 11A to pivotally couple the adjustable head 112A with the housing body 114A at an up-and-down pivotally movable manner so as to pivotally move the adjustable head 112A between a first projecting position and a second projecting position. At the first projecting position, the adjustable head 112A is upwardly and pivotally folded at a horizontal orientation such that the light source 12A will generate the light at the horizontal orientation with respect to the housing body 114A. At the second projecting position, the adjustable head 112A is downwardly and pivotally folded at an inclined orientation such that the light source 12A will generate the light at the downward projecting orientation with respect to the housing body 114A, as shown in FIG. 11.

Accordingly, the light housing 11A further has a first biasing surface 115A formed at a rear side of the adjustable head 112A for retaining the adjustable head 112A at the first projecting position and a second biasing surface 116A formed at a bottom side of the adjustable head 112A for retaining the adjustable head 112A at the second projecting position. The first biasing surface 115A is a flat and vertical face arranged to bias against a front side of the housing body 114A when the adjustable head 112A is upwardly and pivotally folded at the first projecting position. The second biasing surface 116A is a flat and inclined face arranged to bias against the front side of the housing body 114A when the adjustable head 112A is downwardly and pivotally folded at the second projecting position. Therefore, the first and second biasing surfaces 115A, 116A formed at two individual dimensions are able to generate the relatively wider adjustable light projecting orientation for conveniently illuminating the predetermined area. It is worth mentioning that the light housing 11A can be selectively rotated via the mounting arrangement 30A to move the adjustable head 112A at a left-and-right direction while the adjustable head 112A can be selectively moved via the joint member 113A at the up-and-down direction. In other words, the light projecting angle of the light source 12A can be selectively adjusted at two different dimensions.

Figure 13:
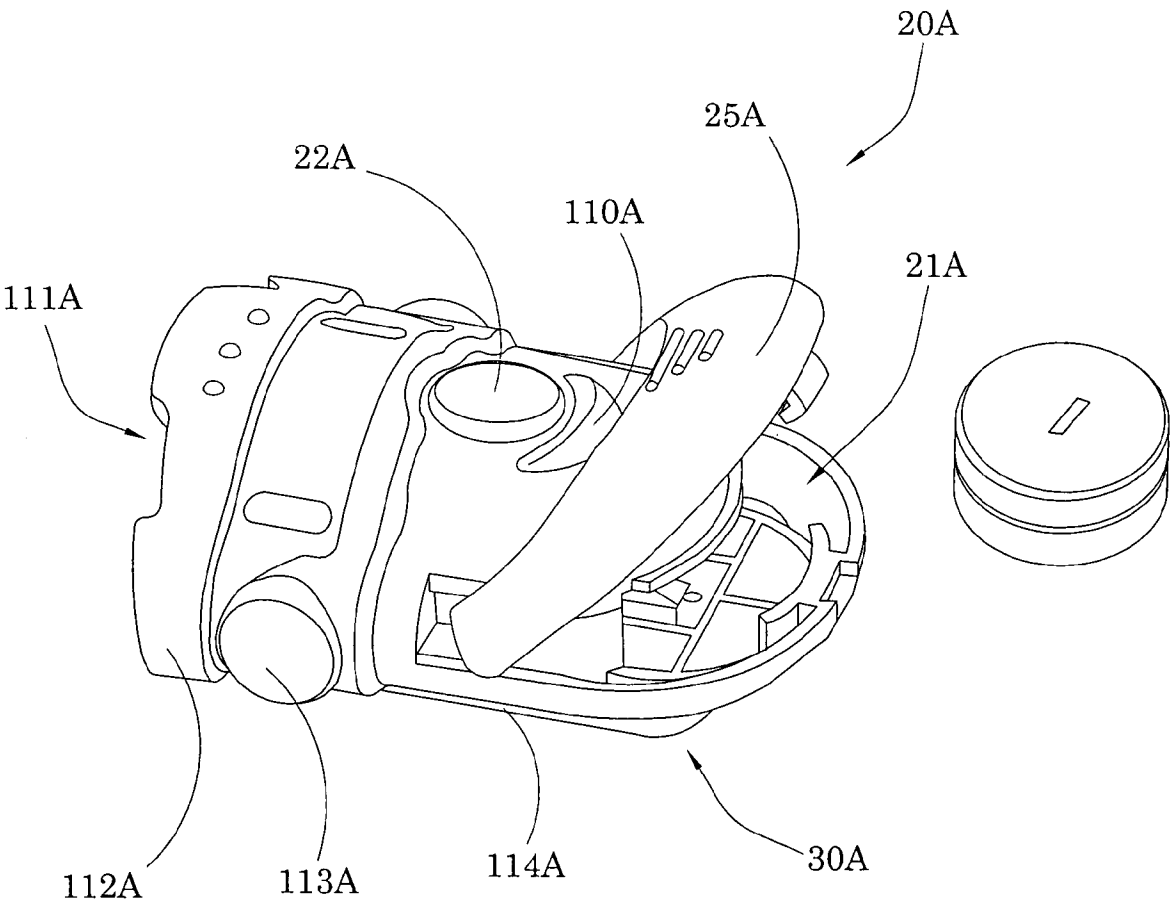
FIG. 13 is a perspective view of the clip light according to the above preferred embodiment of the present invention, illustrating the compartment enclosure being folded to open up the battery compartment.

As shown in FIG. 13, the power source 20A provided within the housing body 114A of the light housing 11A of the light head 10A may further comprise a battery compartment 21A adapted for receiving one or more batteries, such as rechargeable battery or replaceable battery, and a compartment enclosure 25A provided for enclosing the battery compartment 21A. In the preferred embodiment, the compartment enclosure 25A is preferably provided at an un-attachment surface opposed to the attachment surface of the light housing 11A, so that the compartment enclosure 25A is able to be easily opened for accessing the battery compartment 21A. Accordingly, the compartment enclosure 25A is pivotally coupled at the housing body 114A to selectively enclose the battery compartment 21A when the compartment enclosure 25A is pivotally and upwardly folded with respect to the un-attachment surface of the light housing 11A.

The light source 12A can be a bulb, LED, or the like, and is preferably the LED, wherein the light source 12A may comprise one or more LEDs spacedly and longitudinally supported within the light housing 11A. The LEDs of the light source 12A are electrically connected to the power source 20A preferably powered by the rechargeable battery within the battery compartment 21A to provide an electricity to the light source 12A for generating the light beam toward the light window 111A. The light head 10A may further incorporate with the auxiliary light source 13 as mentioned in the above preferred embodiment for providing additional light to illuminate a designated area or a targeted object aimed by the LED light source 12A.

Accordingly, the power source 20A may further comprise one or more switch controls 22A for controllably switching the light source 12A in an on-and-off manner. The switch control 22A is preferably provided at an opposite unattachment surface of the attachment surface of the light housing 11A and to electrically connected to the power source 20A, so that the switch control 22A is adapted for controlling the clip light in the on-and-off manner. It is worth to mention that the light arrangement can be either mounted at the top side or the bottom side of the visor of the cap via the detachable clipping unit 355A. Therefore, the user is able to actuate the switch control 22A at the unattachment surface of the light housing 11A to control the light head 10A.

As shown in FIG. 12, the light housing 11A further comprises a control guider 110A outwardly protruded from the unattachment surface of the light housing 11A at a position adjacent to the switch control 22A, wherein a height of the control guider 110A is slightly higher than a height of the switch control 22A for blocking the switch control 22A from being actuated unintentionally. Accordingly, the control guider 110A has an arc-shape partially encircling with a rear edge portion of the switch control 22A. Therefore, the switch control 22A must be intentionally pressed down in order to controllably switch the light source 12A in an on-and-off manner.

The light head 10A may further have a light reflection housing 14A having a reflection surface 141A provided to reflectively enhance the light intensity of the light source 12A of the clip light by reflecting the light beam generated form the light source 12A. In other words, the light reflection housing 14A is formed within the adjustable head 112A for retaining the light source 12A therewithin, so that the light beam from the light source 12A and the reflected light reflected from the reflection surface 141A are projected out through the light window 111A of the light housing 11A.

The light housing 11A preferably further comprises a transmissible cover for enclosing and protecting the light reflection housing 11A at the light window 111A and the light source 12A within the light housing 11A. Therefore, the light generated from the light source 12A is projecting through the transmissible cover of the light window 111A.

The rechargeable dock 40 (not shown in this embodiment), as mentioned above, may be adapted for incorporating with the clip light in the preferred embodiment for electrically connecting with an external power supply, such as an external AC power supply, wherein the rechargeable dock 40 preferably has a docking cavity 41 detachably adapted for receiving the light head 10 to charge the power source 20A.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A clip light, comprising:

a light head comprising a light housing having a light window, and a LED light source supported in said light housing to align with said light window, wherein said light housing comprises a housing body, an adjustable head supporting said LED light source thereat, and a joint member pivotally coupling said adjustable head with said housing body to enable said adjustable head being pivotally moved between a first projecting position that said adjustable head is upwardly and pivotally folded at a horizontal orientation and a second projecting position that said adjustable head is downwardly and pivotally folded at an inclined orientation;

a power source supported in said light housing; and a mounting arrangement which comprises a rotatable base rotatably coupling with said light housing and a clipping unit adapted for detachably coupling said light head with a desired object, wherein said light housing is selectively moved to adjust a light projecting orientation of said light source via said rotatable base when said clipping unit is coupled at the desired object, wherein said light housing further has a first biasing surface formed at a rear side of said adjustable head and a second biasing surface formed at a bottom side of said adjustable head, such that when said adjustable head is upwardly and pivotally folded at said first projecting position, said first biasing surface is biased against a front side of said housing body, and when said adjustable head is downwardly and pivotally folded at said second projecting position, said second biasing surface is biased against said front side of said housing body.

2. The clip light, as recited in claim 1, wherein said joint member comprises a pivot axle extending at a longitudinal direction of said light housing to pivotally couple said adjustable head with said housing body at an up-and-down direction.

3. The clip light, as recited in claim 1, wherein said rotatable base comprise a rotatable shaft perpendicularly extended to rotatably couple with said light housing so as to selectively adjust said light housing at a left-and-right direction.

4. The clip light, as recited in claim 2, wherein said rotatable base comprise a rotatable shaft perpendicularly extended to rotatably couple with said light housing so as to selectively adjust said light housing at a left-and-right direction.

5. The clip light, as recited in claim 3, wherein said rotatable base is rotatably coupled at said housing body.

6. The clip light, as recited in claim 4, wherein said rotatable base is rotatably coupled at said housing body.

7. The clip light, as recited in claim 2, wherein said power source has a battery compartment provided at said light housing receiving at least a battery, and a compartment enclosure pivotally coupled with said light housing to selectively enclose said battery compartment.

8. The clip light, as recited in claim 6, wherein said power source has a battery compartment provided at said light housing receiving at least a battery, and a compartment enclosure pivotally coupled with said light housing to selectively enclose said battery compartment.

9. The clip light, as recited in claim 7, wherein said light housing has surface rotatably coupling with said rotatable base and an opposed surface pivotally coupling with said compartment enclosure.

10. The clip light, as recited in claim 8, wherein said light housing has surface rotatably coupling with said rotatable base and an opposed surface pivotally coupling with said compartment enclosure.

11. The clip light, as recited in claim 9, wherein said power source further comprise one or more switch controls provided at said light housing for controllably switching said light source in an on-and-off manner.

12. The clip light, as recited in claim 10, wherein said power source further comprise one or more switch controls provided at said light housing for controllably switching said light source in an on-and-off manner.

13. The clip light, as recited in claim 11, wherein said light head further comprises a light reflection housing received in said adjustable head to retain said light source in position, wherein said light reflection housing has a reflection surface for reflecting light from said light source towards said light window for enhancing a light intensity of said light source.

14. The clip light, as recited in claim 12, wherein said light head further comprises a light reflection housing received in said adjustable head to retain said light source in position, wherein said light reflection housing has a reflection surface for reflecting light from said light source towards said light window for enhancing a light intensity of said light source.

15. The clip light, as recited in claim 14, wherein said light housing further comprises a control guider outwardly protruded from said unattachment surface of said light housing at a position adjacent to said switch control, wherein said control guider has an arc-shape partially encircling with a rear edge portion of said switch control for preventing said switch control being unintentionally actuated.

* * * * *